United States Patent [19]

Cinquin

[11] 4,385,216

[45] May 24, 1983

[54] CIRCUIT BREAKER DEVICES WITH A PYROTECHNICALLY DESTRUCTIBLE CONDUCTOR HAVING A FUSE SYSTEM IN PARALLEL

[75] Inventor: Jean-Pierre Cinquin, Cremieu, France

[73] Assignee: Lucien Ferraz & Cie, Lyons, France

[21] Appl. No.: 290,811

[22] PCT Filed: Dec. 10, 1980

[86] PCT No.: PCT/FR80/00178

§ 371 Date: Aug. 4, 1981

§ 102(e) Date: Aug. 4, 1981

[87] PCT Pub. No.: WO81/01770

PCT Pub. Date: Jun. 25, 1981

[30] Foreign Application Priority Data

Dec. 12, 1979 [FR] France ..... 79 31174

[51] Int. Cl.[3] ..... H01H 35/00

[52] U.S. Cl. ..... 200/61.08; 337/409

[58] Field of Search ..... 337/401, 409; 200/61.08, 146 R

[56] References Cited

U.S. PATENT DOCUMENTS 2,816,196 12/1957 Daudelin ..... 200/61.08

3,264,438 8/1966 Gay ..... 200/61.08 X

FOREIGN PATENT DOCUMENTS 1904244 of 1969 Fed. Rep. of Germany .

923568 of 1959 United Kingdom .

OTHER PUBLICATIONS

Miyoshi, Fukushima, Ultra-high Speed Protection Device, Fuji Ultrup Fuse, Fuji Electric Review, vol. 18, No. 1, pp. 49–51, 1972.

A paper recommended and approved by the IEEE Switchgear Committee of the IEEE Power Engineering Society for presentation at the IEEE PES Summer Meeting, Portland, OR, Jul. 18–23, 1976.

*Primary Examiner*—A. T. Grimley

*Assistant Examiner*—Morris Ginsburg

*Attorney, Agent, or Firm*—Dowell & Dowell

[57] ABSTRACT

A pyrotechnical cartridge or motor (5) is actuated by electric firing from its head (5*c*), and pushes the insulating piston (3) which separates by shearing the intermediate connecting portion (1*b*) of the destructible conductor (1) and pushes it into the bore (1*e*) together with the rod (9), the conical end (9*a*) of which becomes wedged within the plug (10) so as to form a brake. The fuse cartridges (13) then open the circuit in a fully safe manner.

The present invention is useful for instance under the control of overcurrent detectors.

8 Claims, 2 Drawing Figures

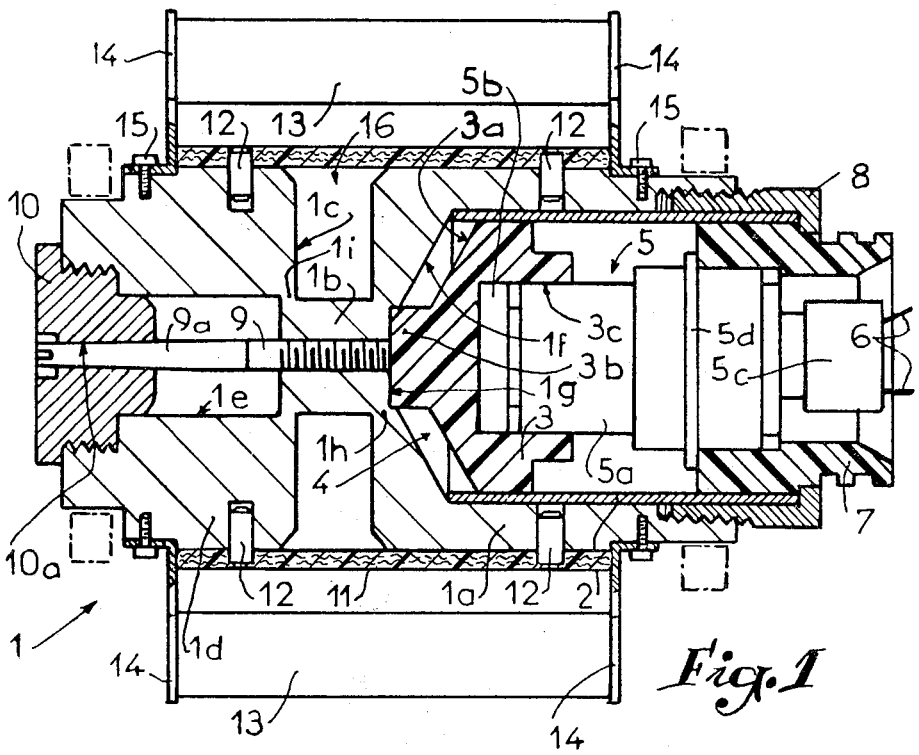
Fig. 1
Fig. 2
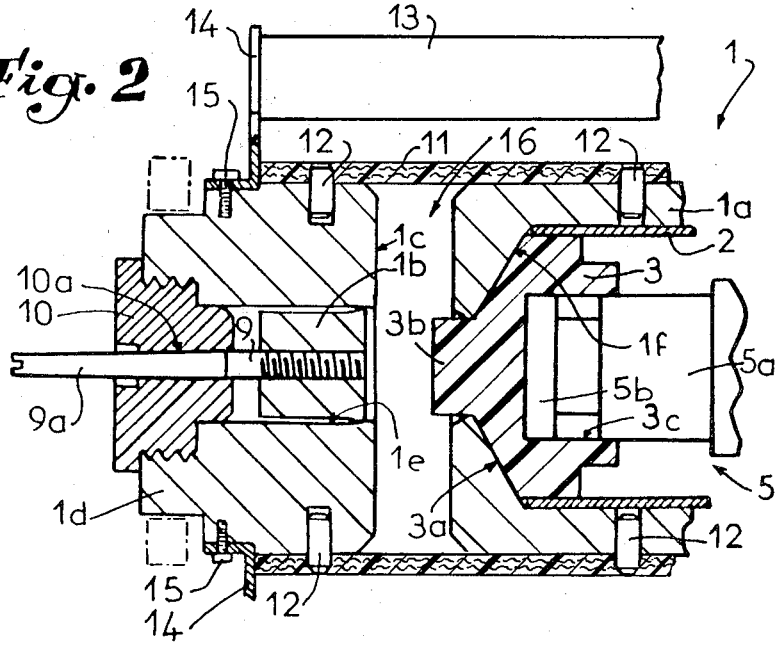

CIRCUIT BREAKER DEVICES WITH A PYROTECHNICALLY DESTRUCTIBLE CONDUCTOR HAVING A FUSE SYSTEM IN PARALLEL

BACKGROUND AND PRIOR ART

An ultra-quick electric current breaker device is known, wherein an insulating member acting as a punching piston is pushed by a pyrotechnical charge in such manner as to sever a destructible electric conductor. The displacement of this piston is generally transverse with respect to the conductor, but it may also be provided as longitudinal. In such a case the destructible conductor includes an upstream portion having the shape of a socket in which the punching piston slides, the outer side of the bottom of this socket extending as an intermediate portion which is slidably engaged into the bore of a downstream portion disposed at a certain distance from this bottom, the three portions being co-axial with respect to each other. When the charge explodes the punching piston severs the bottom of the socket to separate therefrom the intermediate portion which it pushes into the bore of the downstream portion.

The invention aims at improving the devices of this kind.

THE INVENTION

In accordance with the invention the intermediate portion is integral with the downstream portion with which it is connected by an annular zone of reduced cross-section, so that the whole of the destructible conductor constitutes a unitary member.

The annexed drawing, given by way of example, will permit a better understanding of the invention, of the characteristics which it possesses and of the advantages which it may afford.

THE DRAWINGS

FIG. 1 is a general axial section of a device according to the invention at its normal closed circuit position.

FIG. 2 partially reproduces FIG. 1, but the parts being shown at the open circuit position.

The device illustrated in FIG. 1 comprises a destructible conductor 1 affording the shape of a substantially cylindrical body which may be divided into three portions, namely an upstream portion 1*a* in the form of a socket, then an intermediate portion 1*b* the diameter of which is reduced to a considerable extent by an annular groove 1*c*, and finally a downstream portion 1*d* having a blind bore 1*e* with a diameter which is only slightly larger than the diameter of the intermediate portion 1*b*.

The upstream portion defines a cylindrical inner space, the bottom 1*f* of which is in the form of a flaring frustum of a cone with a central cylindrical depression 1*g* of small depth having a diameter which is slightly smaller than the diameter of the intermediate portion 1*b*. The arrangement is such that this depression only leaves a remaining connecting zone 1*h* of small cross-section between this portion 1*b* and the upstream portion 1*a*.

In the same manner, the bottom of the blind bore 1*e* of the downstream portion 1*d* only leaves between this portion and the intermediate portion 1*b* a connecting zone 1*i* having a relatively small cross-section.

The wall of the inner cylindrical space of the upstream portion 1*a* is covered by a sleeve 2 of small thickness made of an insulating material. A piston 3 made of a non-thermoplastic stratified insulating material having a high mechanical strength is slidably mounted in this sleeve, the side of this piston which faces the bottom of the space being shaped in such manner as to correspond to the profile of this bottom, namely with a frusto-conical surface 3*a* and a cylindrical central boss 3*b*, being however noted that the length of this boss is noticeably greater than the depth of the depression 1*g*. The piston 3 is normally fully pushed towards the left in such manner that its boss 3*b* engages the bottom of the depression. An empty space 4 of noticeable width is thus left between the facing frusto-conical surfaces of the bottom of portion 1*a* and of this piston 3.

The side of piston 3 opposed to boss 3*b* is formed with a blind bore 3*c* into which one of the ends of a pyrotechnical motor 5 is engaged. This motor comprises a main metallic body 5*a* which contains the pyrotechnical charge proper, a piston 5*b* which projects from this body to reach the bottom of the blind bore 3*c*, and at its opposed end a head with which the electric firing conductors 6 are connected. Body 5*a* is provided with a rib or flange 5*d* against which rests a ring 7 made of a thermosetting material clamped by the protruding inner edge of a metallic crown 8 screwed into the screw-threaded outlet of the upstream portion 1*a*.

The intermediate portion 1*b* is formed with an axial screw-threaded hole into which the end of a rod 9 is screwed, this rod extending into the blind bore 1*e* of the downstream portion 1*d*. The outlet of this bore is internally screw-threaded to receive a metallic plug 10 formed with an axial bore 10*a* with a small angle of conicity converging outwardly, this bore receiving the end 9*a* of rod 9, provided with identically the same conicity.

The groove 1*c* which defines the intermediate portion 1*b* is closed by a sleeve 11 extending each side of this groove on part of the length of the upstream and downstream portions 1*a* and 1*d*. This sleeve is made of a thermosetting material re-inforced by glass fibres in order to have a high tensile strength in the longitudinal direction. It is clamped to the aforesaid upstream and downstream portions by means of metallic pins 12, whose ends opposed to the axis of the conductor 1 are covered by the material which constitutes the sleeve or by an additional coating, so that these pins may be maintained in position and isolated from the outer atmosphere. It should be noted that the sleeve 11 may be shaped and mounted in such a way as to close the groove 1*c* in a perfectly gas-tight manner, if desired.

The device finally comprises several fuse cartridges 13 regularly disposed around the sleeve 11. The number of these cartridges may vary, as the case may be, the important point being that two at least are provided. The ends of these cartridges are equipped with metallic contact forming squares 14, the horizontal arm of which is permanently secured by means of screws 15 to the upstream and downstream portions 1*a* and 1*d* of the destructible conductor 1 beyond the sleeve 11.

In use the device which has just been described is mounted on an appropriate support by means of metallic clamping collars which surround the ends of the upstream and downstream portions 1*a* and 1*d* so as to form the terminals for the insertion in a circuit. Electric current normally flows almost entirely through the intermediate portion 1*b* the ohmic resistance of which is clearly lower than that of the whole of the cartridges 13 through which therefore only a small fraction of the total current flows, these cartridges being therefore free from any noticeable heating.

The wires 6 being connected with an appropriate controlling apparatus, for instance an overcurrent detector, when the latter emits a signal, the charge within the motor 5 explodes. The inner piston 5*b* of this motor is therefore pushed towards the left and the force which it receives is sufficient to cause the boss 3*b*, acting as a punch, to shear the zones 1*h* and 1*i* which connect the intermediate portion 1*b* with the portions 1*a* and 1*d*. The parts thus come to the position indicated in FIG. 2. The intermediate portion 1*b*, separated from the aforesaid portions 1*a* and 1*d*, has been pushed into the bore 1*e* of the downstream portion 1*d*, while the frusto-conical left side 3*a* of the insulating piston 3 has been applied in the manner of a valve member against the bottom 1*f* of corresponding shape of the inside of the upstream portion 1*a*, thus causing disappearance of the empty space 4 (the air which was in this space having escaped through the leaks of the piston). As the same time the rod 9 has been forced part-way through the plug 10 which has been very slightly expanded, thus realizing a braking effect which prevents the intermediate portion 1*b* from being hurled outwardly in the manner of a projectile.

The flow of the current through the destructible conductor is therefore interrupted and the bulk of the current circulates through the cartridges 13 which, being rated for a much smaller limit of current, blow almost immediately thus definitively opening the circuit.

Owing to the presence of the surrounding sleeve 11, the annular or disconnection chamber 16 defined by the annular groove 1*c* remains isolated from the outside and consequently there cannot appear in this chamber any superficial settling of dust or other impurities capable of creating a conducting path between the upstream and downstream portions 1*a* and 1*d* at the time of the voltage surge which follows the operation of the cartridges 13. It is even possible, if desired, to fill this chamber 16 with an appropriate solid, liquid, or even gaseous material adapted to prevent any formation of an arc during such a surge.

Secondly, owing to the valve effect which results from the almost gas-tight application of the piston 3 against the bottom of the upstream portion 1*a*, the gases issuing from the explosion of the pyrotechnical charge cannot have access to the chamber 16 to cause therein any ionisation phenomena capable of initiating an arc, even if the body 5*a* of the motor has burst. These gases can only escape through the leaks between the parts which close on the right the inner space of the portion 1*a*. Of course there is no objection against possibly exaggerating these leaks by means of grooves, calibrated orifices, etc. if deemed necessary.

It will be noted that the shearing of the intermediate portion 1*b* causes two reactions respectively on the upstream portion 1*a* and on the portion 1*d*. The first one is balanced by a reaction in the opposite direction applied to the ring 7. As to the second one, it is theoritically opposed by the sleeve 11. But experience shows that the shearing phenomenon is of so short duration that the inertia of the bulk of the downstream portion 1*d* is on a practical basis sufficient to oppose axial displacement of it (in other words, if the pins 12 tear locally the sleeve 11, this only appears along a negligible length of the latter and does not modify the operation).

Finally owing to the regular distribution of the cartridges 13 around the destructible conductor 1, the sudden derivation of the bulk of the current through these cartridges does not cause appearance of any noticeable self-induction effect, so that no noticeable voltage surge is generated when the aforesaid conductor is severed.

In order to reduce the outer dimensions of the whole of the device and to render same more compact, it is possible to incorporate the cartridges 13 into the periphery of the sleeve 11. In such a case this sleeve is made with a substantial thickness and longitudinal bores are provided in this thickened wall; cartridges may be achieved in these bores by disposing therein fusible elements with a mass of arc-quenching material, the whole being closed by two metallic heads, in the manner well-known in the art. In a modification this crown of cartridges may be housed in a thick sleeve disposed on the sleeve 11 of FIGS. 1 and 2.

It should, however, be understood that the preceding description has only been given by way of example and that it does not limit the scope of the invention from which one would not depart by replacing the structural details described by any other equivalents.

What is claimed is:

1. A pyrotechnical circuit breaker operative to open an electrical circuit in response to an overload signal, comprising:

a unitary destructible conductor to be connected in series with said electrical circuit, the conductor having axially aligned upstream and downstream portions spaced apart by an annular groove around the conductor forming between said portions an intermediate annular portion integrally joined respectively to said upstream and downstream portions by annular shear zones of reduced thickness, the upstream portion of the conductor having an inner cylindrical space therein axially aligned with said intermediate portion and having an outer end opening away therefrom, and the downstream portion having a bore therein axially aligned with said intermediate portion and opening away therefrom and of diameter sufficient to pass the intermediate portion axially into the bore;

a piston axially slidable in the cylindrical space within the upstream portion, the piston having a boss extending toward the shear zones which join the intermediate portion with the upstream and downstream portions, and the boss being shaped and disposed to punch the intermediate portion from the upstream and downstream portions by tearing the shear zones and to drive the intermediate portion into said bore;

closure means to close the outer end of the opening of the cylindrical space at the end thereof opposite said intermediate portion; and pyrotechnical motor means connectable to receive and be exploded by said overload signal, the motor means being located in the cylindrical space between said piston and said closure means.

2. In a pyrotechnical circuit breaker as claimed in claim 1, said upstream portion having an inner end of said cylindrical space a bottom wall of diameter greater than said intermediate portion, and the piston having an end surface surrounding the boss and shaped to abut said bottom wall and seal thereagainst to prevent entry of gas from the motor means into said annular groove when the boss has punched the intermediate portion of the conductor into said bore.

3. In a pyrotechnical circuit breaker as claimed in claim 1, said upstream and downstream portions having substantially equal outer diameters; an insulating sleeve closely surrounding said destructible conductor and providing a substantially gas-tight fit thereon, the sleeve forming with the annular groove and the adjacent intermediate and upstream and downstream portions an annular disconnection chamber.

4. In a pyrotechnical circuit breaker as claimed in claim 3, said disconnection chamber containing a substance preventing the initiation of an arc therein.

5. In a pyrotechnical circuit breaker as claimed in claim 1, a plug closing the open end of said bore and having an axial opening therethrough; and an axial rod passing through said opening and having an inner end fixed in the intermediate portion of said conductor.

6. In a pyrotechnical circuit breaker as claimed in claim 5, the opening through the plug being conical and enlarging inwardly toward the bore, and the rod having an outer conical surface shaped to enter the opening when the intermediate portion of the conductor has been sheared, and to wedge in the conical opening to brake the axial movement of the intermediate portion in the bore.

7. In a pyrotechnical circuit breaker as claimed in claim 1, an annular series of contacts carried around the peripheries of said upstream and downstream portions respectively; and multiple fuse cartridges attached to and supported by said contacts about said destructible conductor.

8. In a pyrotechnical circuit breaker as claimed in claim 1, a thick wall insulating sleeve closely surrounding said destructible conductor, the sleeve having an annular series of axially disposed bores in its walls; and fuse means in said bores and having opposite ends respectively connected to said upstream portion and to said downstream portion.

* * * * *